US010662389B2

(12) United States Patent
Kim

(10) Patent No.: US 10,662,389 B2
(45) Date of Patent: May 26, 2020

(54) LITHIUM-BASED THICKENER AND GREASE COMPOSITION INCLUDING THE SAME

(71) Applicants: HYUNDAI MOTOR COMPANY, Seoul (KR); KIA MOTORS CORPORATION, Seoul (KR)

(72) Inventor: Jae Hyeon Kim, Geoje-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/161,703

(22) Filed: Oct. 16, 2018

(65) Prior Publication Data

US 2019/0194566 A1 Jun. 27, 2019

(30) Foreign Application Priority Data

Dec. 22, 2017 (KR) ..... 10-2017-0178528

(51) Int. Cl.

| | |
|---|---|
| ***C10M 129/76*** | (2006.01) |
| ***C10M 107/50*** | (2006.01) |
| ***C10M 107/02*** | (2006.01) |
| ***C10M 143/02*** | (2006.01) |

(Continued)

(52) U.S. Cl.

CPC ..... *C10M 129/76* (2013.01); *C10M 107/02* (2013.01); *C10M 107/50* (2013.01); *C10M 117/08* (2013.01); *C10M 143/02* (2013.01); *C10M 143/04* (2013.01); *C10M 2203/1006* (2013.01); *C10M 2205/022* (2013.01); *C10M 2205/026* (2013.01); *C10M 2205/0285* (2013.01); *C10M 2207/1256* (2013.01); *C10M 2207/284* (2013.01); *C10M 2207/2805* (2013.01); *C10M 2207/285* (2013.01); *C10M 2207/288* (2013.01); *C10N 2210/01* (2013.01); *C10N 2230/10* (2013.01); *C10N 2250/10* (2013.01)

(58) Field of Classification Search

CPC ..... C10M 129/76; C10M 107/50; C10M 107/02; C10M 143/02; C10M 117/08; C10M 2205/022; C10M 2205/026; C10M 2207/288; C10M 2203/1006; C10M 2207/284; C10M 2205/0285; C10M 2207/1256; C10M 2207/2805; C10N 2230/10; C10N 2210/01; C10N 2250/10

See application file for complete search history.

(56) References Cited

U.S. PATENT DOCUMENTS 2,712,527 A * 7/1955 Mikeska ..... C10M 169/06 508/493
3,929,651 A * 12/1975 Murray ..... C10M 117/02 508/512

FOREIGN PATENT DOCUMENTS

KR 10-0135414 B1 4/1998
KR 10-0513625 B1 9/2005

(Continued)

*Primary Examiner* — Cephia D Toomer

(74) *Attorney, Agent, or Firm* — Morgan, Lewis & Bockius LLP

(57) ABSTRACT

A lithium-based thickener is contained in an amount of 6 to 14 wt % based on a total weight of a grease composition. The amount of the lithium-based thickener contained in the grease composition can be reduced by about half compared to a conventional thickener, thus effectively increasing viscosity of base oil and reducing fluidity.

8 Claims, 2 Drawing Sheets

(51) Int. Cl.
*C10M 143/04* (2006.01)
*C10M 117/08* (2006.01)

(56) References Cited

FOREIGN PATENT DOCUMENTS

KR 10-2014-0054557 A 5/2014
KR 10-1438916 B1 9/2014

* cited by examiner

[FIG.1]
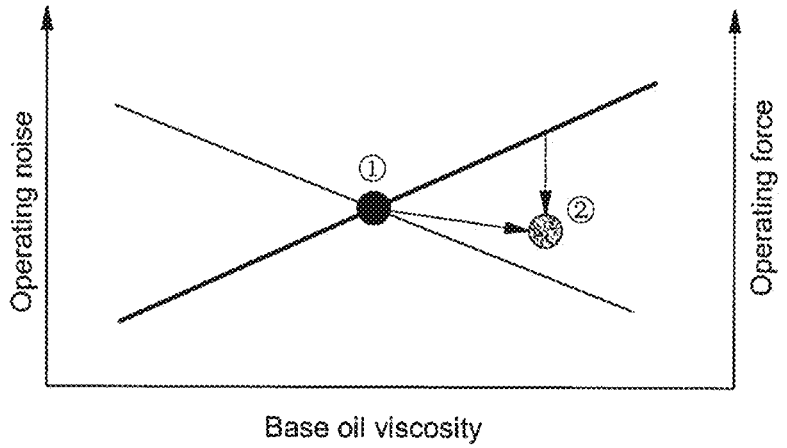
-PRIOR ART-
[FIG.2]
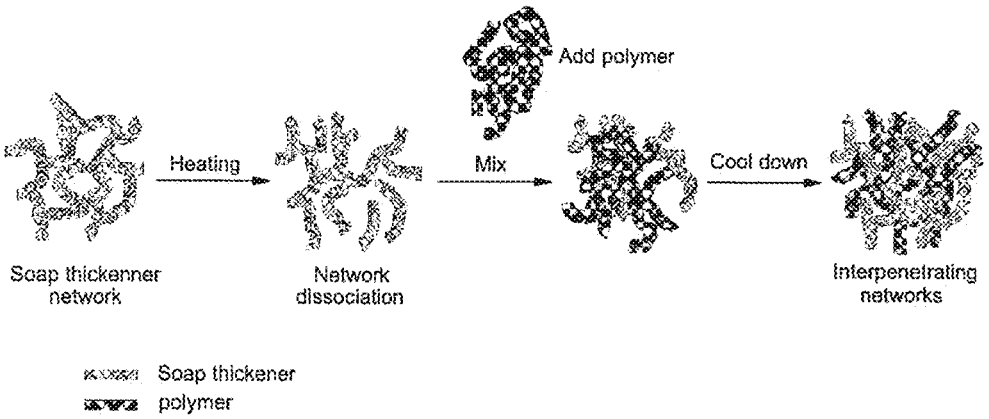

[FIG.3]
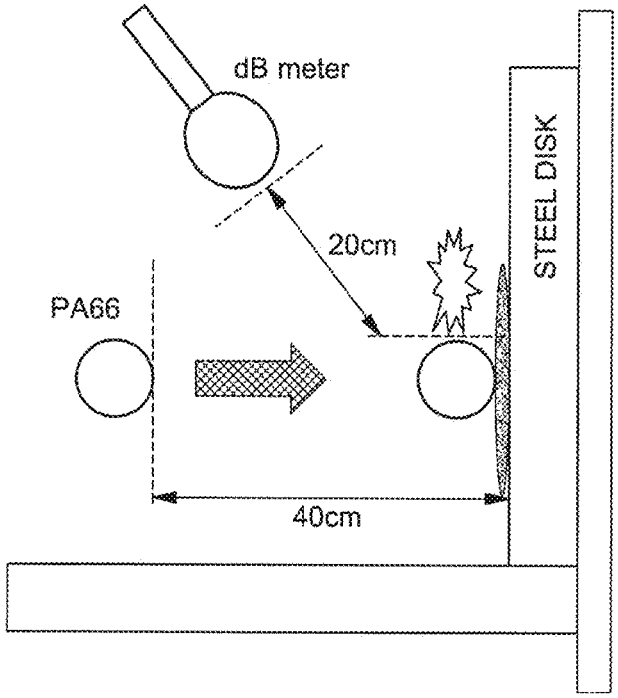

LITHIUM-BASED THICKENER AND GREASE COMPOSITION INCLUDING THE SAME

CROSS-REFERENCE TO RELATED APPLICATION

This application claims, under 35 U.S.C. § 119(a), the benefit of priority to Korean Patent Application No. 10-2017-0178528 filed on Dec. 22, 2017, the entire contents of which are incorporated herein by reference.

TECHNICAL FIELD

The present disclosure relates to a thickener, a grease composition including the same, and a method of preparing a thickener and a grease composition.

BACKGROUND

Grease is a semi-solid lubricant used to optimize the lubrication of mechanical systems, such as bearings, gears, and the like, which are key components for vehicular and industrial applications. Typically, grease is composed of base oil, a thickener, and additives.

The base oil is a component that is added to minimize a change in the viscosity of grease depending on the temperature. The base oil includes expensive ester oil, silicone oil, or fluorine oil, so the use thereof is limited due to problems such as high price. Hence, poly-alpha-olefin (PAO) synthetic base oil, which exhibits superior effects for the price, is mainly used. The thickener is a component that determines the main properties such as heat resistance and water resistance of grease. Since the properties of the grease may vary greatly depending on the choice of additive, the selection not only of the thickener but also of the appropriate additive is regarded as important. Furthermore, in order to improve the high-temperature durability life, an additive, such as an antioxidant, an extreme pressure additive, a corrosion inhibitor, etc., is used.

As technology for environment-friendly vehicles is being rapidly developed, research into the emotional design of the vehicle, which has not been considered in the past, is being actively carried out. Among them, the operating force and noise, vibration, and harshness (NVH) properties of parts that consumers may feel are the top priority. The best way to optimally exhibit the two properties is to change the design or materials and the grease properties. The case of design and material changes is problematic because of many factors to consider, such as costs, effects on surrounding parts, and the like, and thus realizing performance improvements through changes in the mixing design of grease is deemed to be effective.

Typically, operating properties and noise properties are in a trade-off relationship with each other, as shown in FIG. 1, due to the viscosity of the base oil constituting the grease, and when considering noise properties, there are many cases in which low-temperature operation becomes impossible. On the other hand, when considering low-temperature properties, development progresses in a manner in which operating noise is poor.

With the goal of exhibiting optimal performance, the existing grease mixing was performed at point ① shown in FIG. 1.

There is thus a need for grease capable of improving both noise properties and operating properties.

SUMMARY

The present disclosure has been made keeping in mind the problems encountered in the related art, and an aspect of the present disclosure is to provide a grease composition, which may exhibit high viscosity and improved fluidity so as to improve both noise properties and operating properties.

Another aspect of the present disclosure is to provide a novel thickener, which has superior thickening capability in order to reduce the amount of a thickener, based on the results of development toward decreasing the amount of the thickener in order to increase the viscosity of the base oil and to reduce fluidity.

In addition, the present disclosure is intended to provide a grease composition including the thickener and a polymer additive that supplements the thickening capability.

Therefore, the present disclosure provides the following technical solutions.

The present disclosure provides a lithium-based thickener, represented by Chemical Formula 1 below.

[Chemical Formula 1]

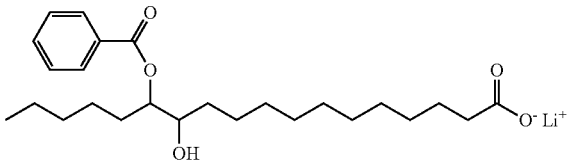

In addition, the present disclosure provides a method of preparing the lithium-based thickener represented by Chemical Formula 1, comprising reacting dihydroxystearic acid with benzoic acid.

In the method of preparing the lithium-based thickener according to an embodiment of the present disclosure, the reacting may include pretreating benzoic acid by dissolving benzoic acid at a temperature of 100° C. to 140° C. and then cooling benzoic acid to a temperature of 70° C. to 90° C.; and reacting the pretreated benzoic acid with dihydroxystearic acid.

In addition, the present disclosure provides a grease composition, comprising a lithium-based thickener represented by Chemical Formula 1 below in an amount of 6 to 14 wt % based on the total weight of the grease composition.

[Chemical Formula 1]

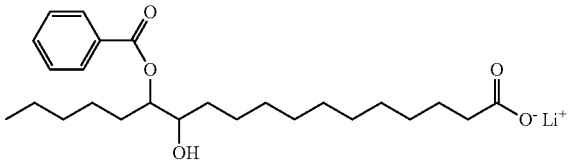

The grease composition according to an embodiment of the present disclosure may further comprise 1 to 5 wt % of a polymer additive based on the total weight of the grease composition, the polymer additive being at least one of an ethylene/propylene copolymer and an ethylene/propylene copolymer grafted with an acid anhydride.

In the grease composition according to an embodiment of the present disclosure, the polymer additive may be a thickening aid that supplements the thickening capability of the lithium-based thickener.

Also, the grease composition according to an embodiment of the present disclosure may comprise 81 to 93 wt % of base oil, 6 to 14 wt % of the lithium-based thickener, and 1 to 5 wt % of the polymer additive, wherein the base oil is at least one of poly-alpha-olefin (PAO) oil, ester oil, silicone oil and mineral oil.

Also, the grease composition according to an embodiment of the present disclosure may comprise 81 to 93 wt % of the base oil, 6 to 14 wt % of the lithium-based thickener, 1 to 5 wt % of the polymer additive, and 1 to 5 wt % of an antioxidant.

In a thickener and a grease composition including the same according to the present disclosure, the amount of the thickener in the composition can be reduced, thus increasing the viscosity of base oil and reducing fluidity.

In a thickener and a grease composition including the same according to the present disclosure, both noise properties and operating properties can be improved.

In a thickener and a grease composition including the same according to the present disclosure, noise properties and operating properties can be improved from the point ① to the point ② shown in FIG. 1.

BRIEF DESCRIPTION OF DRAWINGS

FIG. 1 shows a trade-off relationship between operating properties and noise properties due to viscosity of base oil according to the related art;

FIG. 2 shows a thickening supplementation mechanism of a polymer additive that is responsible for supplementing a function of a thickener; and FIG. 3 shows a measurement of noise properties in Test Example according to the present disclosure.

DETAILED DESCRIPTION OF SPECIFIC EMBODIMENTS

A description of the configuration and functions of the present disclosure is omitted if it is determined that the gist of the present disclosure would be made unclear thereby. As used herein, the term "comprising" or "including" means that other elements may be included unless otherwise specified.

In the present specification, when a range is described for a variable, it will be understood that the variable includes all values including the end points described within the stated range. For example, the range of "5 to 10" will be understood to include any subranges, such as 6 to 10, 7 to 10, 6 to 9, 7 to 9, and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Also, for example, the range of "10% to 30%" will be understood to include any subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

Hereinafter, a detailed description will be given of the present disclosure.

The present disclosure addresses a lithium-based thickener represented by Chemical Formula 1 below.

[Chemical Formula 1]

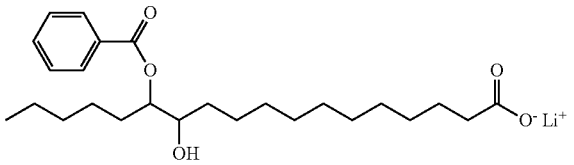

The thickener is prepared by reacting dihydroxystearic acid with benzoic acid, having high polarity, to give an acid, which is then reacted with lithium hydroxide, whereby the amount of the thickener may be reduced by half compared to conventional cases.

In addition, the present disclosure addresses a method of preparing the lithium-based thickener represented by Chemical Formula 1, including reacting dihydroxystearic acid with benzoic acid.

The lithium-based thickener according to the present disclosure may be easily prepared through a typical organic synthesis process. For example, 9,10-dihydroxystearic acid and benzoic acid are esterified and then reacted with lithium hydroxide, thus preparing a lithium salt represented by Chemical Formula 1.

The above reaction is illustrated in Scheme 1 below.

[Scheme 1]

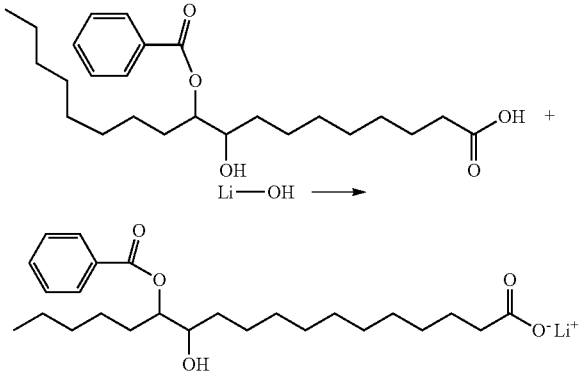

In the method of preparing the lithium-based thickener according to an embodiment of the present disclosure, the reacting may include pretreating benzoic acid by dissolving benzoic acid at a temperature of 100° C. to 140° C. and then cooling benzoic acid to a temperature of 70° C. to 90° C.; and reacting the pretreated benzoic acid with dihydroxystearic acid.

In addition, the present disclosure addresses a grease composition, including a lithium-based thickener represented by Chemical Formula 1 below in an amount of 6 to 14 wt % based on the total weight of the grease composition.

[Chemical Formula 1]

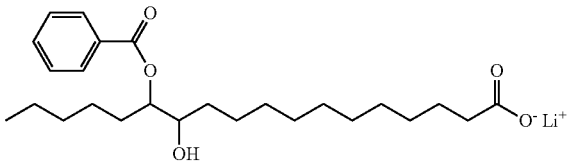

If the amount of the thickener is less than 6 wt %, the grease may become dilute and thus difficult to react. On the other hand, if the amount thereof exceeds 14 wt %, low-temperature (−40° C.) viscosity may increase at low temperatures due to the thickening capability, thus freezing the grease.

The grease composition according to an embodiment of the present disclosure further comprises a polymer additive in an amount of 1 to 5 wt % based on the total weight of the grease composition, the polymer additive being at least one of an ethylene/propylene copolymer and an ethylene/propylene copolymer grafted with an acid anhydride.

The polymer additive may be represented by Chemical Formula 2 below.

[Chemical Formula 2]

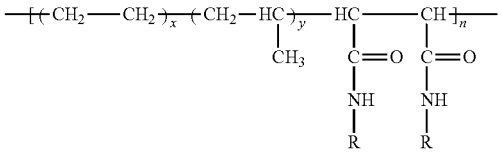

The amount of the polymer additive falls in the range of 1 to 5 wt %. If the amount thereof exceeds 5 wt %, the grease may be increased in viscosity and thus frozen at low temperatures (e.g. −40° C.). If the polymer is not added or the amount thereof is less than 1 wt %, the grease may become too dilute, making it difficult to prepare a semi-solid.

In the grease composition according to an embodiment of the present disclosure, the polymer additive is a thickening aid for supplementing the thickening capability of the lithium-based thickener. FIG. 2 shows a thickening supplementation mechanism of a polymer additive that is responsible for supplementing a function of a thickener. In addition, the grease composition according to an embodiment of the present disclosure comprises 81 to 93 wt % of base oil, 6 to 14 wt % of the lithium-based thickener, and 1 to 5 wt % of the polymer additive, the base oil being at least one of PAO, ester oil, silicone oil, and mineral oil.

In addition, the grease composition according to an embodiment of the present disclosure comprises 81 to 93 wt % of the base oil, 6 to 14 wt % of the lithium-based thickener, 1 to 5 wt % of the polymer additive, and 1 to 5 wt % of an antioxidant.

The grease composition of the present disclosure may further include a typical additive, such as an extreme pressure additive, an antioxidant, and a corrosion inhibitor, and may furthermore include a rust inhibitor, a metal deactivator, etc., as necessary.

The extreme pressure additive is added to enhance load resistance or extreme pressure performance. When a great load is applied to the frictional surface of metal and thus frictional heat is increased, a lubrication function cannot be continuously performed only by the oil membrane of the oil, and thus an extreme pressure additive is contained in the grease composition so as to prevent wear or baking of the frictional surface. In the present disclosure, the selection of the extreme pressure additive is not particularly limited, and the amount thereof may be appropriately adjusted within the amount range, as with a typically used additive. Such an extreme pressure additive is specifically exemplified as follows. An organometallic extreme pressure additive may be used, as necessary, examples of which include an organic molybdenum compound such as molybdenum dithiocarbamate, molybdenum dithiophosphate, etc.; an organic zinc compound such as zinc dithiocarbamate, zinc dithiophosphate, zinc phenate, etc.; an organic antimony compound such as antimony dithiocarbamate, antimony dithiophosphate, etc.; an organic selenium compound such as selenium dithiocarbamate, etc.; an organic bismuth compound such as bismuth naphthenate, bismuth dithiocarbamate, etc.; an organic iron compound such as iron dithiocarbamate, iron octylate, etc.; an organic copper compound such as copper dithiocarbamate, copper naphthenate, etc.; an organic tin compound such as tin maleate, dibutyltin sulfide, etc.; organic sulfonate of alkaline metal or alkali earth metal; organic phosphonate of alkaline metal or alkali earth metal; and organic metal compounds of gold, silver, titanium, cadmium, etc. Examples of a sulfur-based extreme pressure additive may include sulfide or polysulfide compounds such as dibenzyl disulfide, sulfurized oils, ash-free carbamic acid compounds, thiourea-based compounds, and thiocarbonates. Examples of a phosphoric acid-based extreme pressure additive may include phosphoric acid ester, such as trioctyl phosphate, tricresyl phosphate, etc., and phosphoric acid ester-based compounds, such as acidic phosphoric acid ester, phosphorous acid ester, acidic phosphorous acid ester, etc. In addition, a halide-based extreme pressure additive such as paraffin chloride may be used.

The antioxidant may be appropriately selected from among an antiaging agent, an ozone deterioration inhibitor, and an antioxidant, which are typically added to rubber, plastics, and lubricating oil. In the present disclosure, the selection of the antioxidant is not particularly limited, and the amount thereof may be appropriately adjusted within the amount range, as with a typically used additive. Such an antioxidant may be specifically exemplified as follows. An amine-based compound such as phenyl-1-naphthylamine, phenyl-2-naphthylamine, diphenyl-p-phenylenediamine, dipyridylamine, phenothiazine, N-methylphenothiazine, N-ethylphenothiazine, 3,7-dioctylphenothiazine, p,p'-dioctyldiphenylamine, N,N'-diisopropyl-p-phenylenediamine, and N,N'-di-sec-butyl-p-phenylenediamine, a phenol-based compound such as 2,6-di(tert-butyl)phenol, and an organic metal compound thereof may be used.

The corrosion inhibitor is a component typically used. In the present disclosure, the selection of the corrosion inhibitor is not particularly limited, and the amount thereof may be appropriately adjusted within the amount range, as with a typically used additive. Such a corrosion inhibitor may be specifically exemplified as follows. An ammonium salt of organic sulfonic acid; organic sulfonate or organic carboxylate of alkali earth metal; hydroxyl fatty acid such as oleoyl sarcosine; mercapto fatty acid such as 1-mercapto stearic acid; thiazole, and imidazole such as 2-(decyldithio)-benzoimidazole, and benzoimidazole; phosphoric acid ester such as trisnonylphenyl phosphite; and thiocarboxylic acid ester such as dilauryl thiopropionate may be used. Further, a nitrous acid salt may be used.

A better understanding of the present disclosure will be given through the following test example and examples, which are merely set forth to illustrate but are not to be construed as limiting the scope of the present disclosure.

[Preparation Example of Thickener]

(1) Synthesis of Type a Thickener (Existing Thickener)

A type A thickener was prepared through the reaction shown in Scheme 2 below. As reactants, 12-HAS was purchased from Sigma Aldrich, and Li—OH was purchased from FMC Lithium.

[Scheme 2]

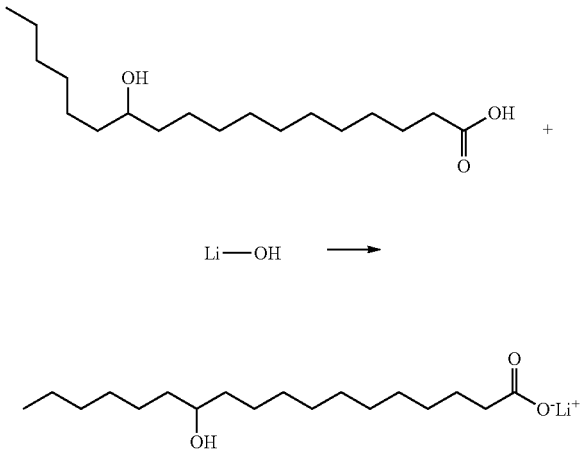

(2) Synthesis of Type B Thickener (Novel Thickener)

Benzoic acid was dissolved at a high temperature of 120° C., cooled to 80° C. and then reacted with 9,10-dihydroxystearic acid.

Next, lithium hydroxide (1.2 mol) was added thereto and reacted at 60° C., thus preparing a lithium salt represented by Chemical Formula 1 below. As reactants, 9,10-dihydroxystearic acid ($C_{18}H_{36}O_4$) was purchased from PubChem and benzoic acid ($C_7H_6O_2$) was purchased from ChemSpider.

[Chemical Formula 1]

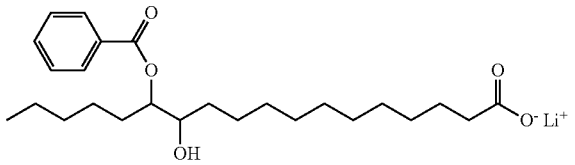

EXAMPLES

Examples 1 to 4 and Comparative Examples 5 to 15: Preparation of Grease

The grease compositions were prepared using components in the amounts shown in Table 1 below.

[Components]

(1) Base oil: PAO synthetic base oil having a kinematic viscosity of 65 cSt at 40° C. (PAO 4, 6, 40, made by Chevron)

(2) Thickener:

(a) Type A thickener prepared in the above Preparation Example: lithium 12-hydroxystearate (b) Type B thickener prepared in the above Preparation Example (3) Polymer: Ethylene/propylene copolymer grafted with acid anhydride (made by Sigma Aldrich)

(4) Additive: Antioxidant Zn-stearate (made by Sigma Aldrich)

TABLE 1

| | | Example | | | | Comparative Example | | | | | | | | | | |
|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 |
| Base oil | PAO | 87 | 85 | 83 | 88 | 83 | 91 | 78 | 78 | 89 | 81 | 84 | — | — | — | 87.5 |
| | Ester oil | — | — | — | — | — | — | — | — | — | — | — | 86 | — | — | — |
| | Silicone oil | — | — | — | — | — | — | — | — | — | — | — | — | 83 | — | — |
| | Mineral oil | — | — | — | — | — | — | — | — | — | — | — | — | — | 86 | — |
| Thickener | Type A | — | — | — | — | 15 | 7 | 15 | — | — | — | — | — | — | — | — |
| | Type B | 6 | 8 | 10 | 8 | — | — | — | 15 | 4 | 7 | 7 | 7 | 10 | 7 | 10 |
| Polymer | | 5 | 5 | 5 | 2 | — | — | 5 | 5 | 5 | — | 7 | 5 | 5 | 5 | 0.5 |
| Additive | | 2 | 2 | 2 | 2 | 2 | 2 | 2 | 2 | 2 | 2 | 2 | 2 | 2 | 2 | 2 |

Type A: 12-HSA + Li—OH

Type B: 9,10-diHSA + Benzoic Acid + Li—OH

Polymer: Ethylene/propylene copolymer grafted with acid anhydride

Additive: Zn-stearate (antioxidant)

Test Example

The properties of the prepared grease compositions were measured as follows.

(1) Noise properties were evaluated through the simple test shown in FIG. 3.

(2) Operating properties were evaluated through measurement of viscosity at different temperatures (including room temperature and low temperature).

Viscosity: DIN 51810

Temperature: −40 to 100° C.

Shear rate: 200 l/s

Gap: 0.3 mm (3) Oil separation, indicative of heat resistance, and penetration, were evaluated in accordance with ASTM, and methods and standards were as follows.

Oil separation: ASTM D6184 (100° C.×24 hr)

Penetration: ASTM D217

The results are summarized in Table 2 below.

TABLE 2

| | | Example | | | | Comparative Example | | | | | | | | | | |
|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 |
| | Noise (dB) | 72 | 72 | 71 | 72 | 76 | 77.5 | 74 | 72 | 77 | — | 71 | 72 | 72 | 71 | 77 |
| Viscosity (Pa · s) | Room Temp. (25° C.) | 6 | 6.8 | 7.1 | 6.2 | 10 | 6.2 | 12 | 13 | — | — | 12.3 | 5.8 | 10.2 | 7.1 | — |
| | Low Temp. (−40° C.) | 43 | 45 | 48.2 | 42 | Frozen | 44 | Frozen | Frozen | — | — | Frozen | 41 | 13.4 | Frozen | — |
| Oil separation | Wt % | 0.2 | 0.2 | 0.2 | 0.4 | 2.4 | 3.6 | 1.8 | 0.1 | 7.8 | — | 0.1 | 0.1 | 0.1 | 0.2 | — |
| Penetration | — | 290 | 282 | 276 | 288 | 282 | 318 | 276 | 262 | 362 Diluted | — Not prepared | 284 | 284 | 278 | 276 | 380 Diluted |

As is apparent from the results of Table 2, the noise properties in Examples 1 to 4 using the novel thickener according to the present disclosure were improved by 3 to 4 dB. Furthermore, viscosity at room temperature was decreased by about 30%, and viscosity at a low temperature was decreased by 27%, from which operating properties were evaluated to be improved.

Although the preferred embodiments of the present disclosure have been disclosed for illustrative purposes, those skilled in the art will appreciate that various modifications, additions and substitutions are possible, without departing from the scope and spirit of the invention as disclosed in the accompanying claims.

What is claimed is:

1. A lithium-based thickener, represented by Chemical Formula 1 below

[Chemical Formula 1]

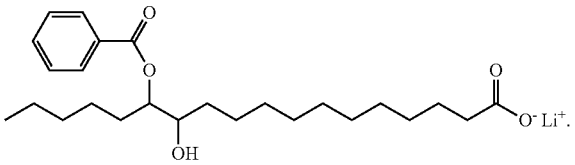

2. A method of preparing the lithium-based thickener of claim 1, comprising a step of reacting dihydroxystearic acid with benzoic acid.

3. The method of claim 2, wherein the step of reacting comprises:

pretreating benzoic acid by dissolving benzoic acid at a temperature of 100° C. to 140° C. and then cooling benzoic acid to a temperature of 70° C. to 90° C.; and reacting the pretreated benzoic acid with dihydroxystearic acid.

4. A grease composition, comprising a lithium-based thickener represented by Chemical Formula 1 below in an amount of 6 to 14 wt % based on a total weight of the grease composition.

[Chemical Formula 1]

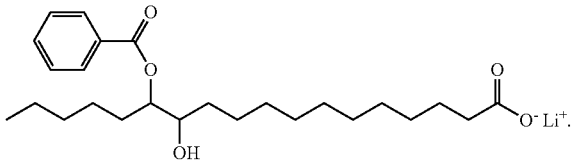

5. The grease composition of claim 4, further comprising 1 to 5 wt % of a polymer additive based on the total weight of the grease composition, wherein the polymer additive includes at least one of an ethylene/propylene copolymer and an ethylene/propylene copolymer grafted with an acid anhydride.

6. The grease composition of claim 5, wherein the polymer additive is a thickening aid that supplements a thickening capability of the lithium-based thickener.

7. The grease composition of claim 5, comprising:

81 to 93 wt % of a base oil;

6 to 14 wt % of the lithium-based thickener; and 1 to 5 wt % of the polymer additive, wherein the base oil is at least one of poly-alpha-olefin (PAO) oil, ester oil, silicone oil, and mineral oil.

8. The grease composition of claim 7, comprising:

81 to 93 wt % of the base oil;

6 to 14 wt % of the lithium-based thickener;

1 to 5 wt % of the polymer additive; and 1 to 5 wt % of an antioxidant.

* * * * *